US007575231B2

(12) United States Patent
Sasaki et al.

(10) Patent No.: US 7,575,231 B2
(45) Date of Patent: Aug. 18, 2009

(54) SHEET FEEDING APPARATUS, SHEET FEEDING METHOD AND CONTROL PROGRAM

(75) Inventors: Ichiro Sasaki, Toride (JP); Keizo Isemura, Koganei (JP); Mitsuhiko Sato, Kashiwa (JP); Naohisa Nagata, Moriya (JP); Akinobu Nishikata, Kashiwa (JP); Hidenori Sunada, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 11/081,736

(22) Filed: Mar. 17, 2005

(65) Prior Publication Data

US 2005/0206068 A1 Sep. 22, 2005

(30) Foreign Application Priority Data

Mar. 22, 2004 (JP) ..... 2004-083349

(51) Int. Cl.
*B65H 3/14* (2006.01)

(52) U.S. Cl. ..... 271/98; 271/153; 271/97

(58) Field of Classification Search ..... 271/152, 271/153, 97, 98
See application file for complete search history.

(56) References Cited

U.S. PATENT DOCUMENTS

| | | | | |
|---|---|---|---|---|
| 5,021,837 | A | 6/1991 | Uto et al. | 355/322 |
| 5,137,265 | A | 8/1992 | Sato et al. | 270/53 |
| 5,203,552 | A | 4/1993 | Hoshi et al. | 271/9 |
| 5,390,016 | A | 2/1995 | Hoshi et al. | 355/308 |
| 5,709,379 | A * | 1/1998 | Lotsch et al. | 271/105 |
| 5,897,250 | A | 4/1999 | Hirai et al. | 399/404 |
| 5,988,629 | A * | 11/1999 | Burlew et al. | 271/152 |
| 6,186,492 | B1 * | 2/2001 | Dechau et al. | 271/30.1 |
| 6,325,585 | B1 | 12/2001 | Sasaki et al. | 412/11 |
| 6,393,232 | B1 | 5/2002 | Osari et al. | 399/82 |
| 6,412,769 | B1 * | 7/2002 | Goda et al. | 271/94 |
| 6,421,523 | B1 | 7/2002 | Kondo et al. | 399/404 |
| 6,651,980 | B2 | 11/2003 | Isemura et al. | 271/259 |
| 6,669,187 | B1 * | 12/2003 | Clark | 271/98 |
| 6,698,747 | B2 * | 3/2004 | Dobbertin et al. | 271/30.1 |
| 6,751,425 | B2 | 6/2004 | Fujimori et al. | 399/69 |
| 6,751,426 | B2 | 6/2004 | Akiba et al. | 399/82 |
| 6,782,236 | B2 | 8/2004 | Sasaki et al. | 399/401 |
| 6,804,474 | B2 | 10/2004 | Moirta et al. | 399/23 |
| 6,908,082 | B2 * | 6/2005 | Dobbertin et al. | 271/152 |
| 2001/0017441 | A1 * | 8/2001 | Yamaguchi et al. | 271/94 |
| 2002/0145246 | A1 * | 10/2002 | Goda et al. | 271/98 |
| 2004/0061280 | A1 * | 4/2004 | Sciurba et al. | 271/152 |
| 2004/0089994 | A1 * | 5/2004 | Koga et al. | 271/98 |
| 2004/0135307 | A1 * | 7/2004 | Dobbertin et al. | 271/152 |
| 2007/0096387 | A1 * | 5/2007 | Sciurba et al. | 271/152 |

FOREIGN PATENT DOCUMENTS

| | | |
|---|---|---|
| JP | 6-82537 | 5/1985 |
| JP | 5-8903 | 1/1993 |
| JP | 7-89625 | 4/1995 |
| JP | 10-67442 | 3/1998 |

* cited by examiner

*Primary Examiner*—Kaitlin S Joerger
(74) *Attorney, Agent, or Firm*—Fitzpatrick, Cella, Harper & Scinto

(57) ABSTRACT

A sheet feeding apparatus provided with a fan for blowing air against sheets stacked on a sheet tray, a position detecting sensor for detecting the position of the sheets floated up by the fan, and a tray lifting and lowering mechanism for lifting and lowering the sheet tray. The tray lifting and lowering mechanism is controlled on the basis of a result of detection by the position detecting sensor.

6 Claims, 13 Drawing Sheets

SHEET FEEDING APPARATUS, SHEET FEEDING METHOD AND CONTROL PROGRAM

BACKGROUND OF THE INVENTION

1. Field of the Invention

The invention relates to a sheet feeding apparatus for and a sheet feeding method of feeding a sheet to a predetermined position, and a control program for executing a controlling method for the sheet feeding apparatus.

2. Related Background Art

An image forming apparatus such as a color copying machine or a color printer has heretofore been provided with a sheet feeding apparatus for feeding a sheet cut into a predetermined size to a transferring position in order to transfer a toner image formed on a photosensitive member onto the sheet at the transferring position.

As the sheet feeding apparatus, besides one utilizing a frictional roller, there is also, for example, one which air feeds sheets stacked on a stacking tray (see Japanese Patent Application Laid-Open No. S60-082537). According to this apparatus, for example, in order to effect sheet feeding, air is blown against the uppermost portion of the sheets to thereby float up the sheets, and thereafter air suction is effected to thereby suck the uppermost sheet and feed the sheet.

However, depending on the differences in sheet conditions such as the material of the surface of the sheet used, the basis weight of the sheet and the surface smoothness of the sheet, the magnitude of the close contacting force between adjacent sheets in a sheet bundle differs greatly. As this close contacting force between the sheets becomes greater, there occurs a case where it becomes impossible to effect sheet separation by the blowing of the air, and this has led to the problem that the types of actually applicable sheets are restricted to a certain extent.

Such a problem is expected to be further actualized in the future, in color copying machines and color printers as well as offset printing machines, due to the new trend to use sheets of high smoothness such as art paper, coat paper and film to achieve a high quality of image. Particularly under a high-temperature and high-humidity environment, such sheets of high smoothness as mentioned above, because of being very high in the close contacting force between sheets as compared with plain paper, have the possibility that double feed may occur frequently or feeding is not smoothly effected but wrong feeding may occur frequently.

In order to solve these problems, there are known techniques disclosed, for example, Japanese Patent Application Laid-Open No. H07-089625 and Japanese Patent Application Laid-Open No. H10-067442. In Japanese Patent Application Laid-Open No. H07-089625, when air is to be blown against stacked sheets to thereby float the sheets, the uppermost sheet position is detected and on the basis of the result of the position detection, the air discharge amount to be blown is adjusted to thereby control the position of the floated-up sheets.

Also, in Japanese Patent Application Laid-Open No. H10-067442, when air is to be blown against stacked sheets to thereby float up the sheets, the uppermost sheet position is detected and an air nozzle discharging the air is moved to the detected position to thereby control the position of the floated-up sheets.

However, to deter the state of the floated-up sheets within a predetermined range by the use of the aforedescribed technique of the air discharging force control (Japanese Patent Application Laid-Open No. H07-089625) or the air nozzle movement control (Japanese Patent Application Laid-Open No. H10-067442), taking into account the differences in sheet conditions such as the material of the surface of the sheet used, the basis weight of the sheet and the smoothness of the surface of the sheet, there become necessary a hard part which can control an air discharging force or an air nozzle movement amount at high resolving power.

For example, in a case where the rotating speed of a fan motor is minutely changed to thereby realize the control of the air discharging force, there becomes necessary an electric circuit for linearly changing the rotating speed of the fan motor. Particularly, when a very wide range of air discharging force is required, there is the possibility that a plurality of fans conforming to the discharging force must be mounted and one of the plurality of fans must be selected on the basis of the sheet conditions to thereby minutely control the rotating speed of the fan motor.

Also, in a case where an air nozzle moving motor is added to thereby realize the control of the air nozzle movement, there become necessary a mechanical mechanism and a motor driving circuit necessary to move the air nozzle.

In a case where any of these techniques is used, it is impossible to avoid an increase in the cost of the apparatus itself, and this has led to the problem that a sheet feeding apparatus of high performance cannot be realized at a low cost.

SUMMARY OF THE INVENTION

In view of the above-noted problems peculiar to the conventional art, the present invention has as its object to provide a sheet feeding apparatus and a sheet feeding method of high performance and low cost which can realize stable sheet feeding without being affected by the materials of sheets, a control program and an image forming apparatus for executing a controlling method for the sheet feeding apparatus.

In order to achieve the above object, the sheet feeding apparatus of the present invention for feeding sheets has:

- a sheet tray on which the sheets are stacked;
- a fan which blows air against the sheets so as to float up the sheets stacked on the sheet tray;
- a tray lifting and lowering mechanism which lifts and lowers the stacking tray; and
- a position detecting sensor which detects the position of the sheets floated up by the fan;
- the tray lifting and lowering mechanism being controlled so as to adjust the position of the sheet tray on the basis of the result of detection by the position detecting sensor.

Also, the sheet feeding method of the present invention successively executes:

- an air discharging step of blowing air against sheets stacked on a sheet tray on which the sheets are stacked to thereby float up the sheets;
- a position detecting step of detecting the position of the sheets floated up by the air discharging step;
- an adjusting step of adjusting the position of the sheet tray on the basis of the result of detection by the position detecting step; and
- a feeding step of feeding the sheets.

Also, the computer-readable control program of the present invention for executing a controlling method for a sheet feeding apparatus for feeding sheets, the sheet feeding apparatus having a sheet tray on which sheets are stacked, a fan which blows air against the sheets so as to float up the sheets stacked on the sheet tray, a tray lifting and lowering mechanism which lifts and lowers the sheet tray, and a position detecting sensor which detects the position of the sheets floated up by the fan, and provided with an adjusting step of controlling the lifting and lowering operation of the tray lifting mechanism on the basis of the result of detection by the position detecting sensor to thereby adjust the position of the sheet tray.

Also, the image forming apparatus of the present invention has:

a sheet feeding apparatus for feeding sheets, having a sheet tray on which sheets are stacked, a fan which blows air against the sheets so as to float up the sheets stacked on the sheet tray, a tray lifting and lowering mechanism which lifts and lowers the sheet tray, and a position detecting sensor which detects the position of the sheets floated up by the fan;

an image forming unit which forms images on the sheets fed by the sheet feeding apparatus; and a controller which controls the tray lifting and lowering mechanism so as to adjust the position of the sheet tray on the basis of the result of detection by the position detecting sensor.

DESCRIPTION OF THE PREFERRED EMBODIMENTS

Embodiments of the sheet feeding apparatus, the sheet feeding method and the control program of the present invention will hereinafter be described with reference to the drawings. The sheet feeding apparatus according to the present embodiment will be described as being applied to an air feeding unit carried on an image forming apparatus such as, for example, a color copying machine or a color printer, but is not restricted to such an apparatus. That is, it can be applied to all of apparatuses for feeding a cut sheet to a predetermined position.

<Construction of the Image Forming Apparatus According to the Embodiment>

Figure 1:
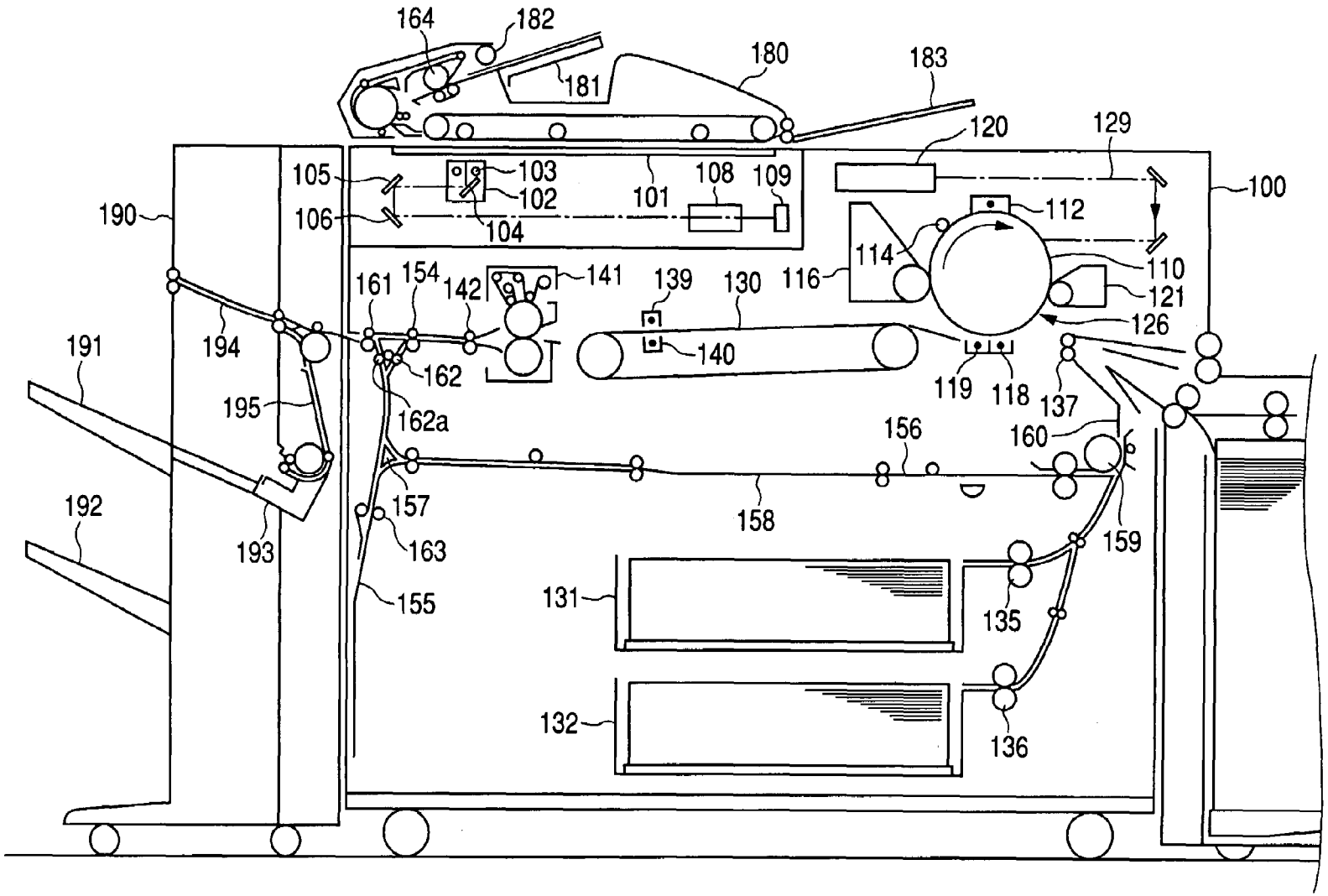
FIG. 1 is a cross-sectional view showing the construction of an image forming apparatus on which is carried an air feeding unit according to an embodiment of the sheet feeding apparatus of the present invention.

FIG. 1 is a cross-sectional view showing the construction of an image forming apparatus on which is carried an air feeding unit according to an embodiment of the sheet feeding apparatus of the present invention.

In FIG. 1, the reference numeral 100 designates an image forming apparatus main body. The reference numeral 101 denotes platen glass (original plate) as an original placing stand. The reference numeral 102 designates a scanner comprised of an original illuminating lamp 103, a scanning mirror 104, etc. The image of an original placed on the platen glass 101 is scanned by the scanner 102 controlled so as to be reciprocally moved in predetermined directions (leftward and rightward directions as viewed in FIG. 1) by a motor (not shown). Reflected light from the original is transmitted through a lens 108 via scanning mirrors 104 to 106 and is imaged on an image sensor portion (CCD sensor) 109, whereby it is converted into an electrical signal.

The reference 120 denotes an exposure controlling portion comprised of a laser output portion and a polygon scanner or the like, and it applies a laser beam 129 to the photosensitive drum 110 of an image forming portion 126. The laser beam 129 is modulated on the basis of an image signal obtained as a result of predetermined image processing which will be described later having been effected on an electrical signal resulting from photoelectrically converting the reflected light of the original outputted from the image sensor portion 109.

As what constitute the image forming portion 126, a primary charging device 112, a developing device 121, a transfer charging device 118, a separation charging device 119, a cleaning apparatus 116 and a pre-exposure lamp 114 are provided around the photosensitive drum 110. The photosensitive drum 110 is rotatively controlled in the direction indicated by the arrow as shown in FIG. 1 by a motor (not shown), and is charged to desired potential by the primary charging device 112, and thereafter has the laser beam 129 applied thereto from an exposure controlling portion 120, whereby an electrostatic latent image is formed on the surface of the drum. The electrostatic latent image formed on the photosensitive drum 110 is developed and visualized as a toner image by the developing device 121.

On the other hand, a sheet fed from an upper cassette 131 or a lower cassette 132 is conveyed to the image forming apparatus main body 100 by conveying rollers 135 and 136, and passes through a main body conveying path 160, and thereafter is fed to a feed belt 130 by registration rollers 137. Thereafter, the toner image visualized on the photosensitive drum 110 is transferred to the sheet by the transfer charging device 118. On the photosensitive drum 110 after the transfer, any residual toner is removed by the cleaning apparatus 116, and any residual charges are eliminated by the pre-exposure lamp 114.

The sheet after the transfer is separated from the image forming portion 126 by the separation charging device 119, and is conveyed leftwardly as viewed in FIG. 1 by the feed belt 130. The toner image on the sheet is re-charged by before-fixing charging devices 139 and 140, and is pressurized and heated in a fixing device 141, whereby it is fixed on the sheet. The sheet thus subjected to fixing is discharged out of the main body 100 by sheet discharging rollers 142.

A sheet discharging flapper 154 changes over a sheet path on a sheet discharging side and a sheet path on a two-side recording side or a multiplex recording side. The sheet discharged from the sheet discharging rollers 142 is conveyed to the sheet path on the two-side recording side or the multiplex recording side when the sheet discharging flapper 154 is upwardly raised. In case of two-side recording, the sheet subjected to the fixing on the first side thereof is discharged from the sheet discharging rollers 142, and is reversed through a reversing path 155, and is directed to a re-feeding tray 156 through a lower conveying path 158.

A multiplex flapper 157 changes over a two-side recording sheet path and a multiplex recording sheet path. The multiplex flapper 157 is brought down in the left direction, whereby the sheet is directly directed to the lower conveying path 158 without the intermediary of the reversing path 155. By the sheet being directly directed to the lower conveying path 158 without the intermediary of the reversing path 155, multiplex recording becomes possible. A feeding roller 159 feeds the sheet to the image forming portion 126 side through a sheet path 160.

Discharge rollers 161 disposed near the sheet discharging flapper 154 operates so as to discharge the sheet fed out from the sheet discharging rollers 142 to the outside of the apparatus in a state in which the sheet discharging flapper 154 changed over to the discharging side (a state in which it is not upwardly raised). As previously described, during two-side recording (two-side copying) and multiplex recording (multiplex copying), the sheet discharging flapper 154 is upwardly raised and the sheet subjected to fixing is stored in the re-feeding tray 156 through the lower conveying path 158.

The sheets stored in the re-feeding tray 156 are separated one by one from the lowermost sheet by the feeding roller 159, and the separated sheet is again directed to the registration rollers 137 of the image forming apparatus main body 100 through the sheet path 160.

When the sheet is to be discharged from the image forming apparatus main body 100 with its front and back sides reversed, the sheet discharging flapper 154 is upwardly raised and the multiplex flapper 157 is brought down in the right direction. Thereby, the sheet to be discharged is once fed to the reversing path 155 side, and at the timing whereat the trailing edge of the sheet has passed a first feeding roller 162, the sheet is conveyed to a second feeding roller 162*a* by a reversing roller 163, and is discharged out of the apparatus by the discharge rollers 161.

An automatic original conveying apparatus (DF) 180 separates only the uppermost sheet from an original bundle placed on an original placing stand 181 by a feeding roller 182, and conveys it onto the platen 101 by an original feeding roller 164. Thereafter, the original is scanned by the scanner 102, and the scanned original is discharged onto an original discharging stand 183 or is again returned onto the original placing stand 181.

A discharged sheet treating apparatus 190 aligns and binds the sheets discharged from the image forming apparatus main body 100. When a discharged sheet bundle aftertreatment operation such as sorting or stapling is not set, the sheet passes through a conveying path 194 and is discharged onto a sheet discharging tray 191 without the intermediary of a treatment tray 193. On the other hand, when the discharged sheet bundle aftertreatment operation is set, the sheets discharged one by one through a conveying path 195 are stacked and aligned on the treatment tray 193. After the discharge of the sheet in the first sheet image forming has been completed, the sheet bundle is stapled, and is discharged in the form of a bundle to the sheet discharging tray 191 or 192.

When the discharged sheet bundle aftertreatment operation is set, basically the sheets are bundle-discharged to the sheet discharging tray 192, but depending on a condition such as the fully stacking state of the sheet discharging tray 192, control is effected so as to change over the destination of discharge to the sheet discharging tray 191. The sheet discharging trays 191 and 192 have their upward and downward movement controlled by a motor (not shown), and are moved so that before the start of the image forming operation, the tray stacking the discharged sheets thereon may come to the position of the treatment tray.

Figure 2:
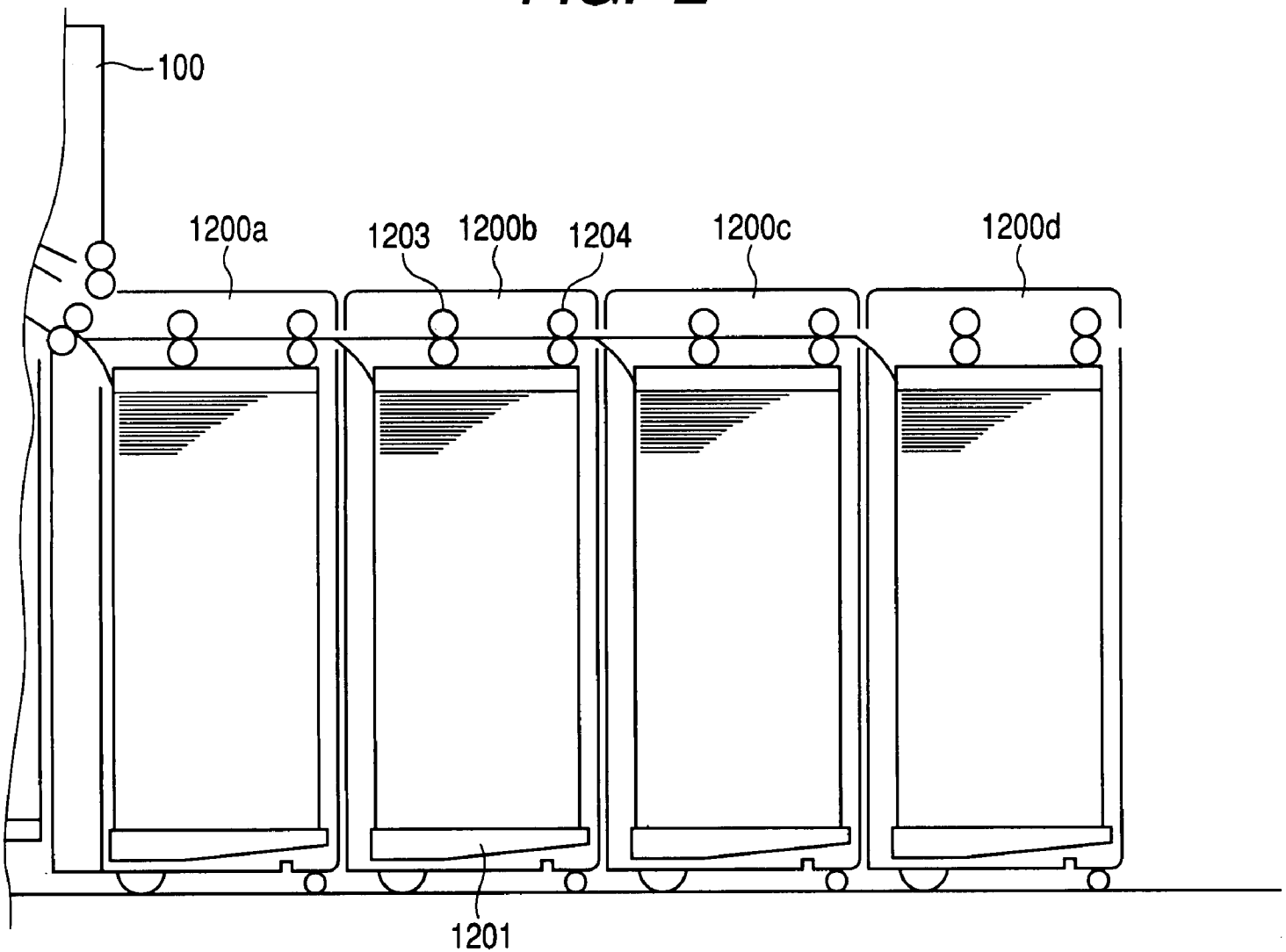
FIG. 2 is a cross-sectional view showing the construction of a sheet deck connected to an image forming apparatus main body shown in FIG. 1.

FIG. 2 is a cross-sectional view showing the construction of sheet decks connected to the image forming apparatus main body 100 shown in FIG. 1.

A plurality of large-capacity sheet decks 1200*a* to 1200*d* are connected in series to the image forming apparatus main body 100 shown in FIG. 1. Each of the sheet decks 1200*a* to 1200*d* is provided with a lifter 1201 and a remaining amount detecting sensor (not shown) for detecting the remaining amount of sheets, and the lifter 1201 is adapted to be moved up in accordance with the amount of sheets so that the sheets may always exist at a feeding position. Further, the sheet decks 1200*a* to 1200*d* have a sheet conveying path, and feed the sheet sent from an upstream side (the right side as viewed in FIG. 2) to a downstream side by conveying rollers 1203 and 1204.

Accordingly, in a system wherein the plurality of sheet decks 1200*a* to 1200*d* are connected as in the present embodiment, the sheets fed by the upstream deck are successively conveyed therefrom through the conveying path of the downstream sheet deck, and are finally fed to the image forming apparatus main body 100. The conveying path is designed to be capable of performing the conveying operation even when a sheet container is brought into an open state in order to supply the sheets. Also, design is made such that sheet information such as the sheet size, sheet type and basis weight of the sheets to be stored in the respective sheet decks 1200*a* to 1200*d* can be set from an operating portion (not shown).

The upper cassette 131 and lower cassette 132 in the image forming apparatus main body 100 and further, the sheet decks 1200*a* to 1200*d*, are provided with an air feeding unit (sheet feeding apparatus) forming a feature of the present embodiment which will be described later in detail with reference to FIGS. 5 to 8, and the sheets reliably separated one by one by this air feeding unit are successively conveyed to the image forming portion 126 by the conveying rollers 135 or 136, or conveying rollers 1203 and 1204.

Figure 3:
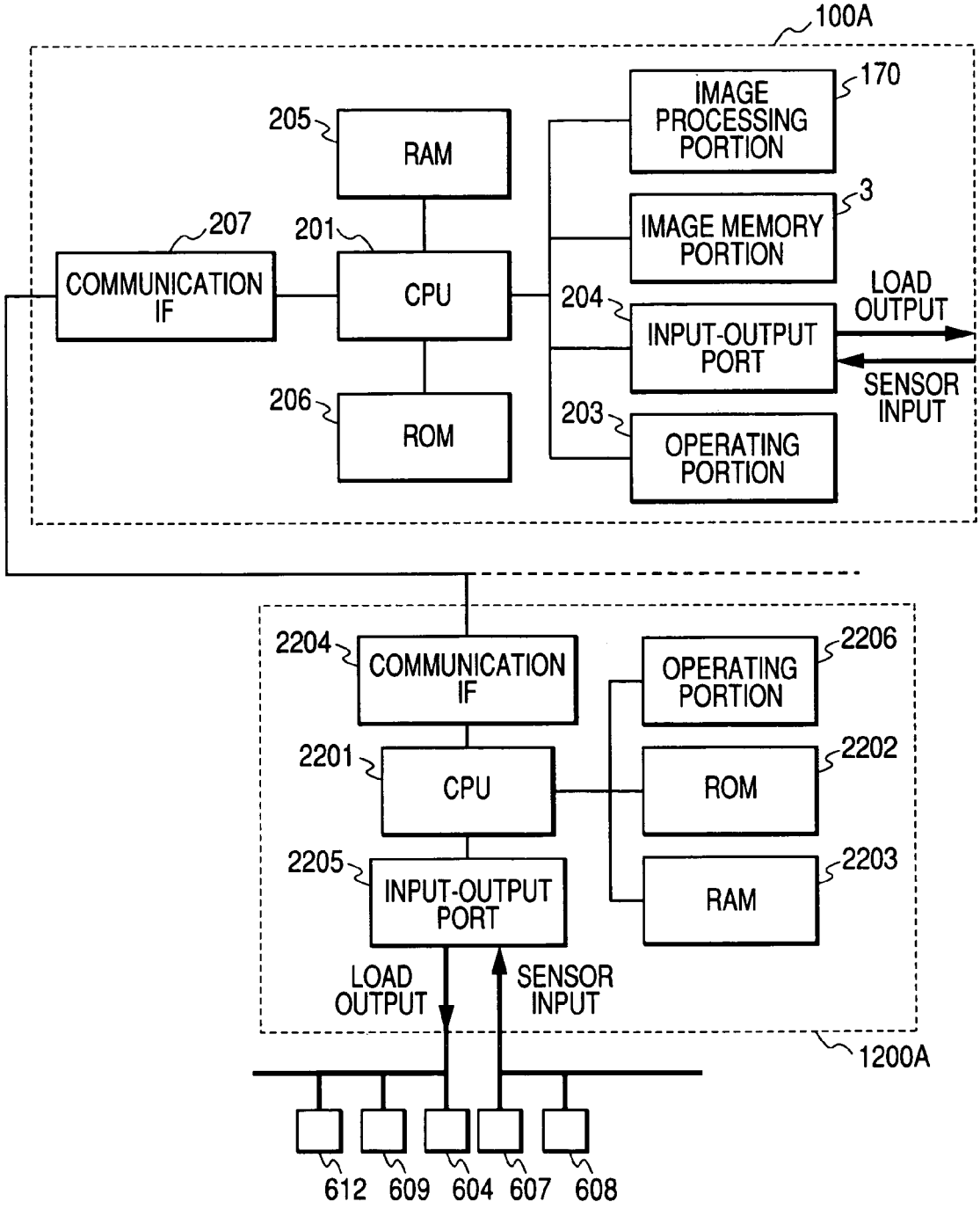
FIG. 3 is a block diagram showing the constructions of the image forming apparatus main body and the sheet deck.

FIG. 3 is a block diagram showing the constructions of a controlling portion 100A in the image forming apparatus main body 100 shown in FIG. 1, and the controlling portion 1200A of the sheet decks shown in FIG. 2.

The controlling portion 100A in the image forming apparatus main body 100 is comprised of a CPU 201, a ROM 206, a RAM 205, a communication interface (I/F) 207, an input-output port 204, an operating portion 203, an image processing portion 170 and an image memory portion 3.

The CPU 201 effects the basic control of the image forming apparatus main body 100, and the ROM 206 into which a control program is written, the work RAM 205 for effecting processing, and the input-output port 204 are connected to an address bus by a data bus. Some area of the RAM 205 is a backup RAM from which data is not erased even if a power supply is switched off. The input-output port 204 has connected thereto various load devices such as a motor and a clutch controlled by the image forming apparatus main body 100, and an input device such as a sensor for detecting the position of the sheet.

The CPU 201 sequentially effects the control of an input and an output through the input-output port 204 in accordance with the contents of the control program stored in the ROM 206, and executes an image forming process. Also, the CPU 201 has the operating portion 203 connected thereto, and controls the displaying portion and the key inputting portion of the operating portion 203. A user instructs the CPU 201 to change over an image forming operation mode and display through the key inputting portion of the operating portion 203, and the CPU 201 effects the display of the operating state of the image forming apparatus main body 100 and the operation mode set by a key input, to the displaying portion of the operating portion 203. Further, the CPU 201 has connected thereto the image processing portion 170 for processing a signal converted into an electrical signal by the image sensor portion 109, and the image memory portion 3 for accumulating processed images therein.

The controlling portion 1200A of the sheet deck 1200 is comprised of a CPU 2201, a ROM 2202, a RAM 2203, a communication interface (I/F) 2204, an input-output port 2205 and an operating portion 2206 in order to realize the operation described with reference to FIG. 2. The CPU 2201 inputs the results of detection thereto from an upper limit sensor 608 and a lower limit sensor 607 which will be described later, through the input-output port 2205, and outputs a driving command to a tray lifting and lowering motor 604, a loosening fan 609 and a feed fan 612 which will be described later.

Figure 4:
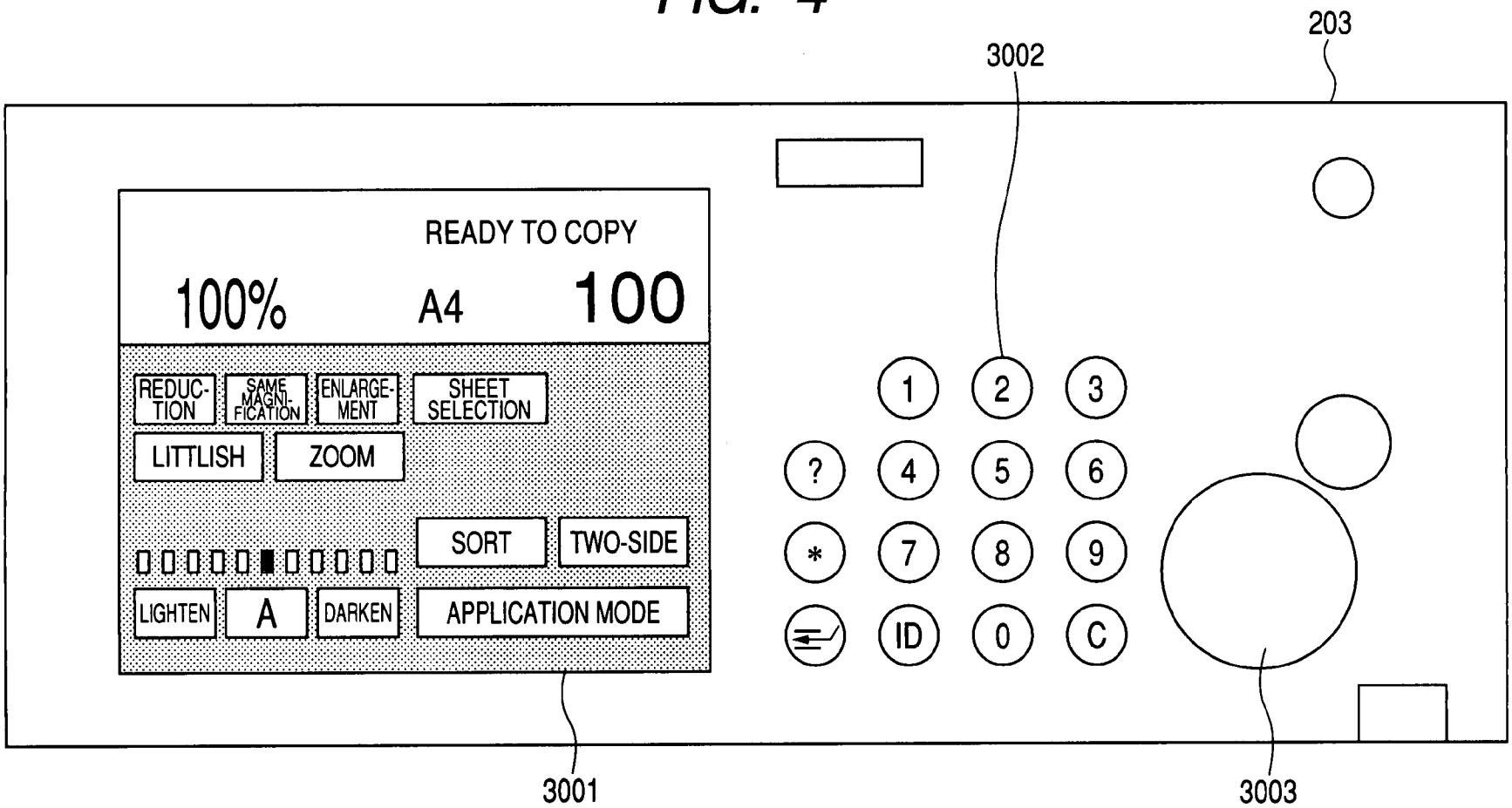
FIG. 4 is a schematic view showing the construction of an operating portion in the image forming apparatus according to the embodiment.

FIG. 4 is a schematic view showing the construction of the operating portion 203 in the image forming apparatus according to the present embodiment.

In FIG. 4, the reference numeral 3001 designates a displaying portion on which are displayed various messages such as the operating state of the apparatus and work instructions to the user, and a work procedure or the like. Also, the surface of the displaying portion 3001 is constituted by a touch panel, and by being touched, it works as a selecting key. The reference numeral 3002 denotes ten keys for inputting numerals. The reference numeral 3003 designates a start key, and by depressing this key, a copying operation is started.

<Construction of the Air Feeding Unit>

Description will now be made of the construction of an air feeding unit forming a feature of the present embodiment.

Figure 5:
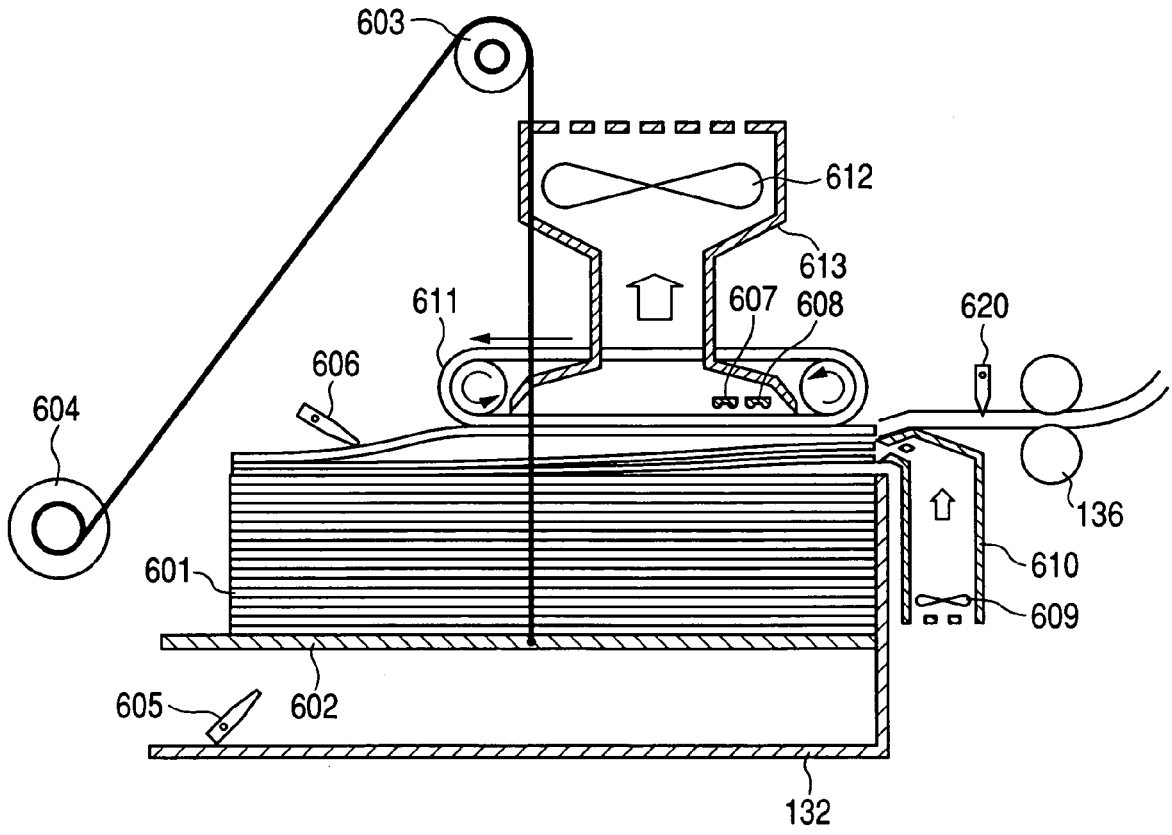
FIG. 5 is a cross-sectional view showing the construction of the air feeding unit carried on the image forming apparatus according to the embodiment.

FIG. 5 is a cross-sectional view showing the constructions of the air feeding unit carried on the above-described image forming apparatus and the peripheral portion of the cassette 132.

The air feeding unit according to the present embodiment is provided not only in the cassette 132, but also in the cassette 131 in the above-described image forming apparatus main body 100 and the large-capacity sheet decks 1200*a* to 1200*d*. Here, the air feeding unit provided in the cassette 132 will be described as an example.

In FIG. 5, a cassette floor plate 602 as a sheet tray for stacking sheets thereon is provided in the interior of the cassette 132. The cassette floor plate 602 is movable up and down by the driving of a tray lifting and lowering motor 604 via a pulley 603. By the cassette floor plate 602 being lifted and lowered, a sheet bundle stacked on the cassette floor plate 602 is moved up and down.

An encoder is mounted on the tray lifting and lowering motor 604, and it is possible to know the driving amount of the tray lifting and lowering motor 604, i.e., the amount of vertical movement of the cassette floor plate 602, by this encoder. A tray lower limit detecting sensor 605 is provided to detect the lower limit position of the cassette floor plate 602.

On the other hand, above the air feeding unit, there are disposed a sheet presence or absence detecting sensor 606 for detecting the height of the sheets, a sheet float-up lower limit sensor 607 and a sheet float-up upper limit sensor 608. The sheet presence or absence detecting sensor 606 detects the sheets by a flag sensor. The sheet float-up lower limit sensor 607 and the sheet float-up upper limit sensor 608 detect the sheets by optical type sensors.

The sheet presence or absence detecting sensor 606 is disposed below the sheet float-up lower limit sensor 607 and the sheet float-up upper limit sensor 608, and design is made such that when a sheet bundle 601 stacked on the cassette floor plate 602 comes up to a feeding start position, the sheet presence or absence detecting sensor 606 can detect the upper surface of the sheet bundle 601 earlier than the sheet float-up lower limit sensor 607 and the sheet float-up upper limit sensor 608.

Also, the sheet float-up lower limit sensor 607 and the sheet float-up upper limit sensor 608 are sensors for detecting the position of the sheets floated up by wind pressure by the loosening fan 609 which will be described later. The sheet float-up lower limit sensor 607 is sensitivity-adjusted so as to be capable of detecting the floated-up sheet located below the sheet float-up upper limit sensor 608. Consequently, design is made such that whether the floated-up sheets are located within a predetermined range can be detected by the use of the sheet float-up lower limit sensor 607 and the sheet float-up upper limit sensor 608. The relation between the detecting state of the sheet float-up lower limit sensor 607 and the sheet float-up upper limit sensor 608 and the sheet feeding state will be described later.

Further, the loosening fan 609 and a loosening fan duct 610 are installed for the purpose of loosening the sheet bundle 601 contained in the cassette 132 prior to the feeding operation. Wind pressure in a discharging direction produced by the loosening fan 609 being rotated is given to the neighborhood of the uppermost sheet of the sheet bundle 601 by the loosening fan duct 610, whereby a plurality of sheets are prevented from being fed at a time (=double feed) during the sheet feeding operation.

Also, a feed belt 611, a feed fan 612 and a feed fan duct 613 are installed as a sheet feeding mechanism. Wind pressure in a sucking direction produced by the feed fan 612 being rotated is given to the feed belt 611 through the feed fan duct 613. The uppermost sheet of the sheet bundle 601 is sucked onto the feed belt 611 by the wind pressure given to the feed belt 611. The sheet sucked onto the feed belt 611 is conveyed to a feeding retry sensor 620 and a pulling-out roller 136 side by the feed belt 611 being rotated in a direction indicated in FIG. 5.

Figure 12:
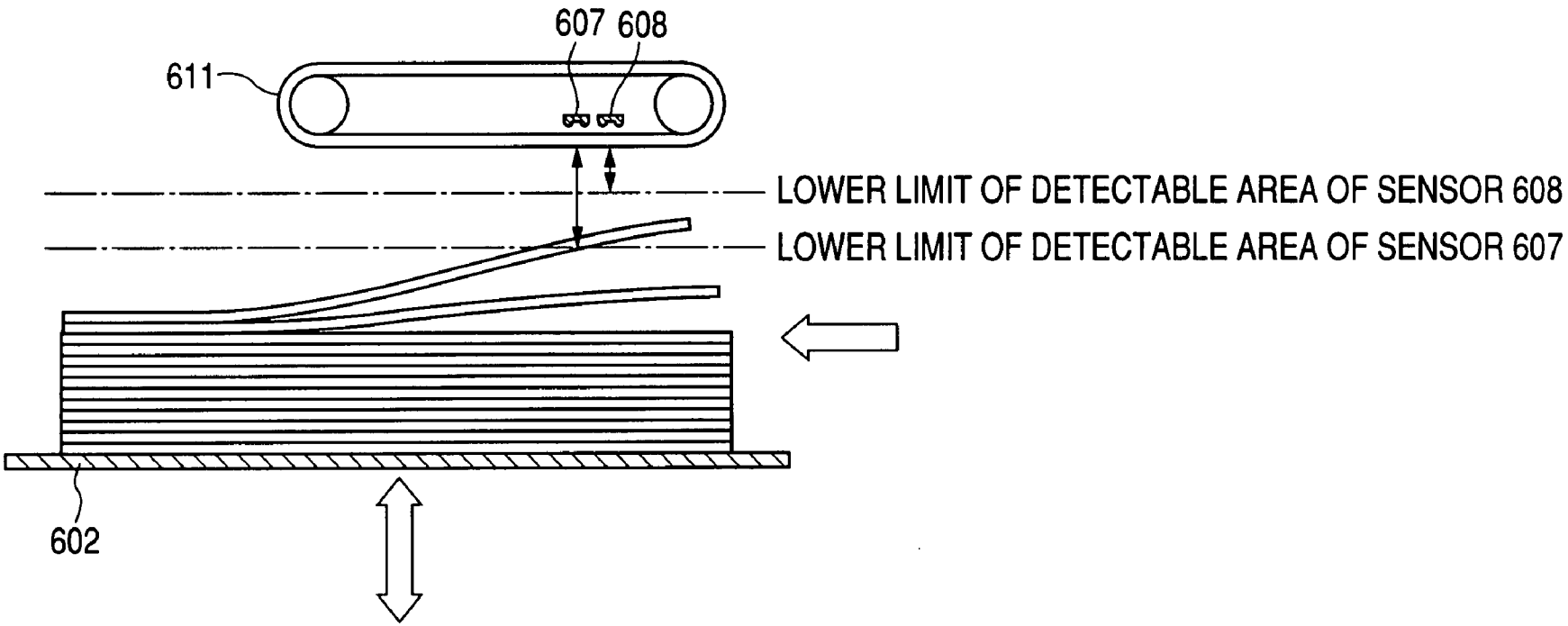
FIG. 12 shows the lower limits of a sheet detectable by a sheet float-up lower limit sensor and a sheet float-up upper limit sensor.

FIG. 5 shows a state in which the sheet has been sucked by the feed fan 612, but when the sheet float-up lower limit sensor 607 and the sheet float-up upper limit sensor 608 are to detect the floated-up position of the sheets, as shown in FIG. 12, during the time when the feed fan 612 is not operated, but the loosening fan 609 is operated, the upward and downward movement of the cassette floor plate 602 is controlled on the basis of the sheet float-up lower limit sensor 607 and the sheet float-up upper limit sensor 608, as will be described later.

The lower limits of the sheet detectable by the sheet float-up lower limit sensor 607 and the sheet float-up upper limit sensor 608 are as shown in FIG. 12. In FIGS. 5 and 12, the sheet float-up lower limit sensor 607 and the sheet float-up upper limit sensor 608 are arranged in a sheet feeding direction, but may be arranged in a direction perpendicular to the sheet feeding direction, whereby more accurate detection becomes possible.

<Sheet Feeding Control of the Air Feeding Unit>

Description will now be made of the sheet feeding control of the air feeding unit of the above-described construction.

Figure 6:
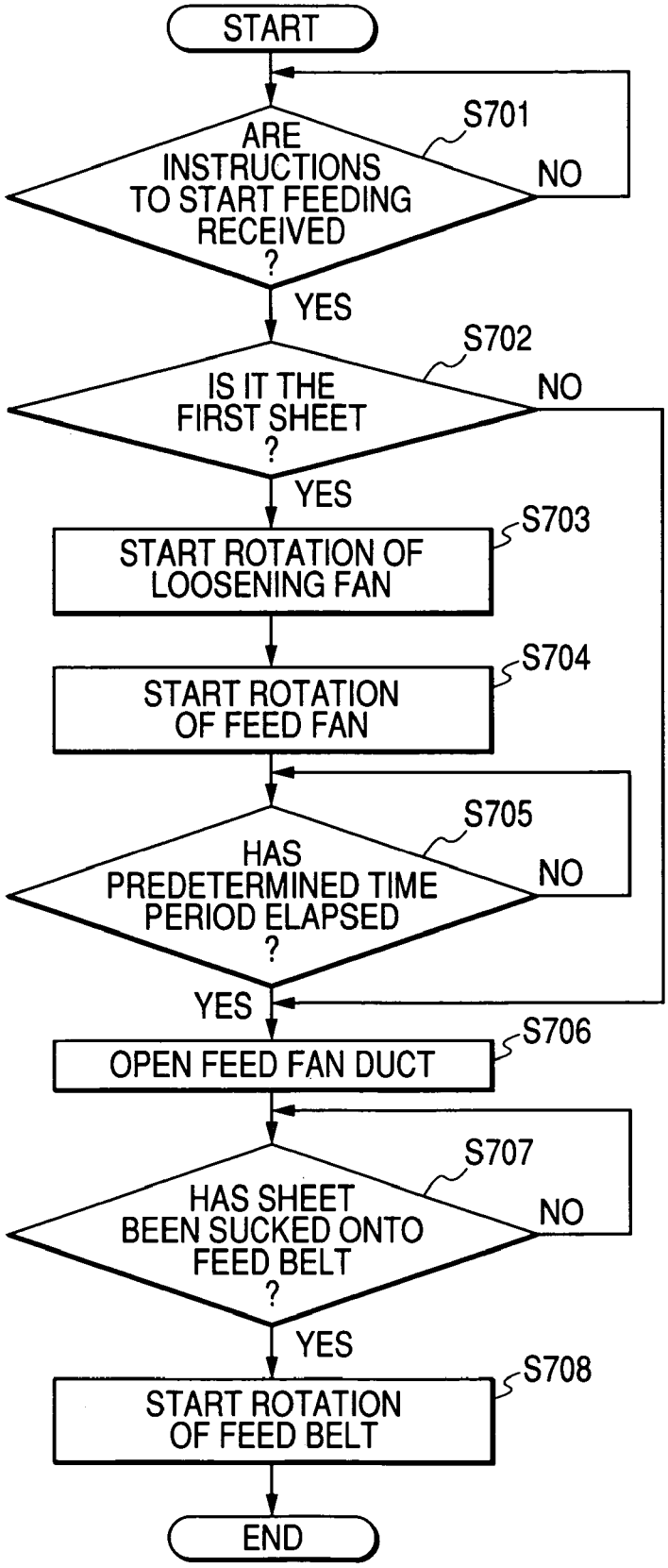
FIG. 6 is a flow chart showing the sheet feeding control of the air feeding unit according to the embodiment.

FIG. 6 is a flow chart showing the sheet feeding control of the air feeding unit according to the present embodiment. A program according to the flow chart of FIG. 6 is stored in the ROM 2202 in the controlling portion 1200A and is executed, whereby it is possible to realize the following controlling method. The program according to the flow chart of FIG. 6 is stored in the ROM 206 in the controlling portion 100A of the image forming apparatus main body 100 and is executed, whereby it is also possible to realize the following controlling method.

First, when at a step S701, instructions to start feeding are received, whether the sheet is the first sheet to be subjected to the feeding operation is determined at the next step S702. If at the step S702, it is the first sheet, at a step S703, the rotation of the loosening fan 609 is started in order to float up the uppermost sheet and subsequent several sheets of the sheet bundle 601, and at a step S704, the feed fan 612 is rotated to cause the sheets to be sucked onto the feed belt 611.

Next, at a step S705, waiting is effected for longer one of the time from the start of the rotation of the loosening fan 609 until the uppermost sheet is floated up and it becomes possible to sufficiently loosen the sheets, and the time until the feed fan reaches wind pressure sufficient to cause the sheets to be sucked, and then, at a step S706, the feed fan duct 613 is brought into an open state in order to cause the upper sheet to be sucked onto the feed belt 611.

Thereafter, at a step S707, waiting is effected until a sheet sucking sensor (not shown) detects that the sheet has been sucked onto the feed belt 611, and at a point of time whereat the sucking of the sheet could be detected, at a step S708, the feed belt 611 is rotated to thereby start the sheet feeding to the image forming portion 170.

On the other hand, if at the step S702, the sheet is not the first sheet, the processing of the step S703 to the step S705 is not carried out, but at predetermined timing, the feeding of the sheets is effected by only the processing of the step S706 and subsequent steps.

<Relation Between the Sheet Surface Position of the Floated-Up Sheet and the Sheet Feeding State>

Figure 7:
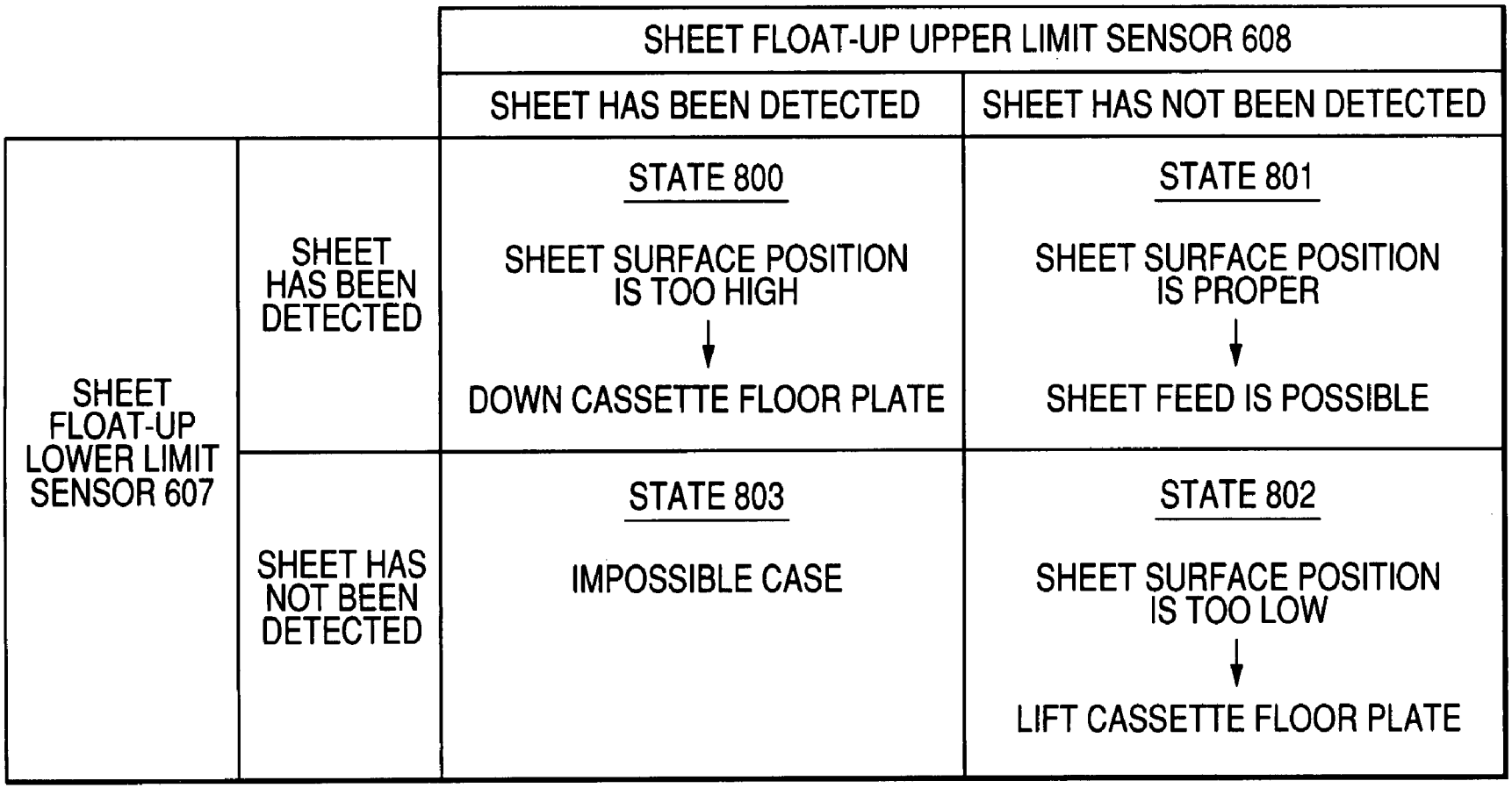
FIG. 7 shows the relation between the sheet surface position of a floated-up sheet and a sheet feeding state.

FIG. 7 shows the relation between the sheet surface position of the floated-up sheet and the sheet feeding state.

Reference is now had to this FIG. 7 to describe below the sheet surface position of the uppermost sheet floated by the loosening fan 609 is related to the sheet feeding state.

In a state 800, both of the sheet float-up lower limit sensor 607 and the sheet float-up upper limit sensor 608 have detected the sheet. That is, this is a state in which the sheet surface of the floated-up uppermost sheet has come too close to the feed belt 611, and is a state in appropriate to sheet feeding in which the sheets floated up beneath the uppermost sheet may be highly liable to be also sucked together to thereby cause double feed.

A state 803, like the state 800, is a state in which the sheet float-up upper limit sensor 608 has detected the sheet surface, but the sheet float-up lower limit sensor 607 has not detected the sheet surface, and this is a state in which one of the sensors 607 and 608 is highly probably abnormal and normal control cannot be expected. In the present embodiment, design is made such that when this state occurs, the user, the operator or a serviceman is notified of the trouble of the air feeding unit and if the air feeding unit is in operation, it is stopped and the sheet feeding from the cassette and the sheet deck which are in an abnormal state is inhibited.

A state 802 is a state in which neither of the sheet float-up lower limit sensor 607 and the sheet float-up upper limit sensor 608 has not detected the sheet, that is, the sheet surface of the floated-up uppermost sheet is too far from the feed belt 611, and is a state inappropriate to sheet feeding in which the uppermost sheet cannot be sucked onto the feed belt 611 to thereby cause faulty feeding with a high possibility.

A state 801 is a state in which the sheet float-up lower limit sensor 607 has detected the sheet and the sheet float-up upper limit sensor 608 has not detected the sheet, and is a state appropriate to sheet feeding in which such problems as double feed and faulty sheet feeding may not arise.

<Sheet Surface Position Control>

Figure 8:
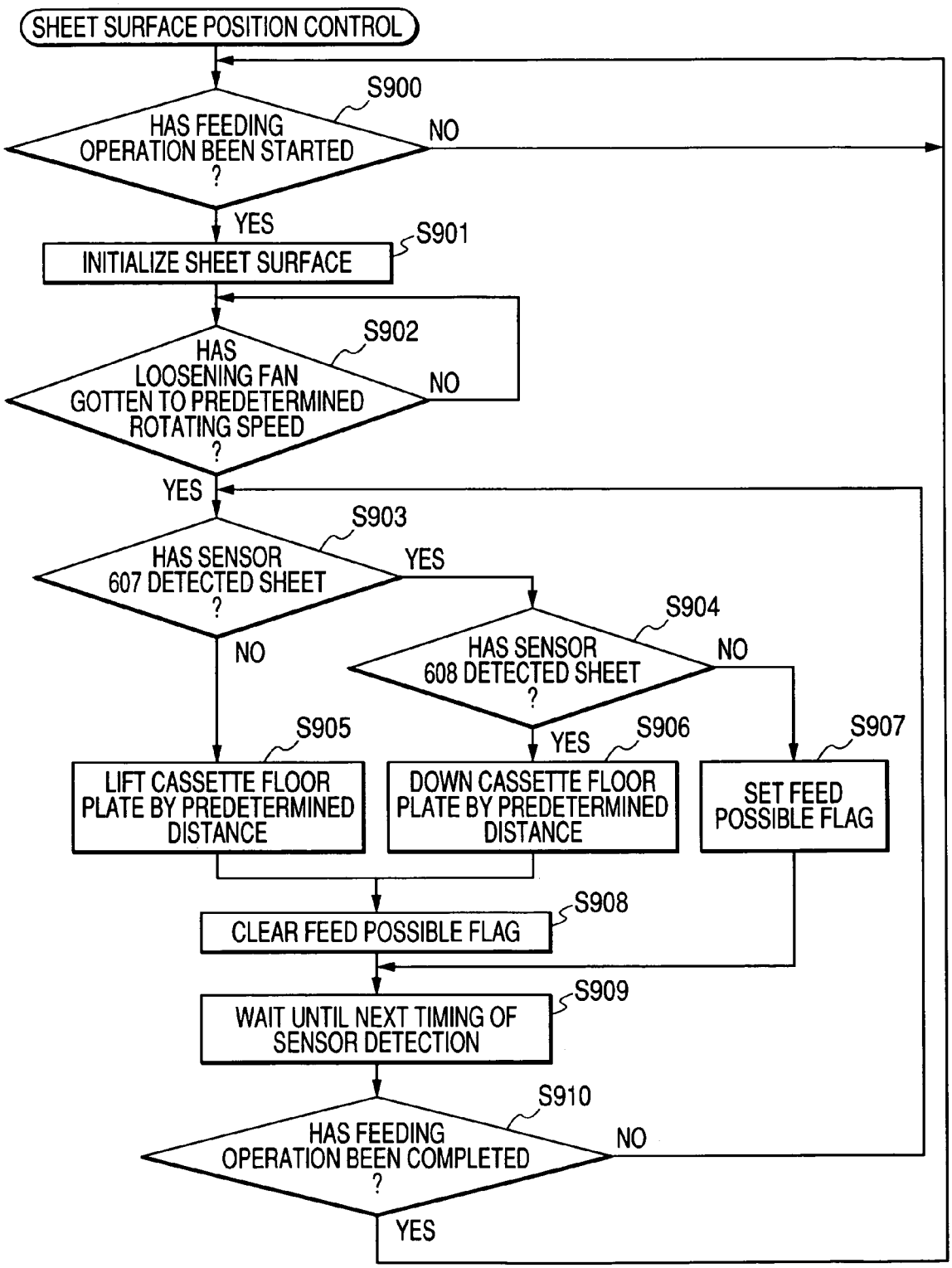
FIG. 8 is a flow chart showing the sheet surface position control of the air feeding unit according to the embodiment.

Reference is now had to the flow chart of FIG. 8 to describe the sheet surface position control of the uppermost sheet for locating the sheet surface of the floated-up uppermost sheet in the above-described appropriate state 801.

FIG. 8 is a flow chart showing the sheet surface position control of the air feeding unit according to the present embodiment, and this sheet surface position control is executed during the aforedescribed sheet feeding control of FIG. 6. A program according to the flow chart of FIG. 8 is stored in the ROM 206 in the controlling portion 100A and is executed, whereby it becomes possible to realize the following controlling method.

First, at a step S900, whether the feeding operation has been started is determined, and when the feeding operation is started, at a step S901, the operation of initializing the sheet surface is performed before the loosening fan 609 is rotated and the uppermost sheet is floated up. In the present embodiment, the sheet surface initializing position is above the sheet presence or absence detecting sensor 606, and near the sheet float-up lower limit sensor 607 with the difference in the setting of the wind pressure of the loosening fan 609 resulting from the difference in the materials of the sheets taken into account.

At the next step S902, whether the loosening fan 609 has reached a predetermined rotating speed is determined. That is, design is made such that waiting is effected until there is brought about a state in which wind pressure optimum for floating up the sheet is produced, thereafter the sheet surface position control of a step S903 and subsequent steps is started.

At the step S903, whether the sheet float-up lower limit sensor 607 has detected the sheet surface is first determined. If the sensor 607 has not detected the sheet surface, at a step S905, the tray lifting and lowering motor 604 is driven to lift the cassette floor plate 602 by a predetermined distance, thereafter at a step S908, the sheet feed possible flag is cleared to thereby stop the sheet feeding operation.

On the other hand, if at the step S903, the sensor 607 has detected the sheet surface, whether the sheet float-up upper limit sensor 608 has detected the sheet surface is determined at a step S904. If at the step S904, the sensor 608 has not detected the sheet surface, it is judged that this is a state appropriate to the sheet feeding operation, and at a step S907, the sheet feed possible flag is set to thereby start the sheet feeding operation (for example, when the sheet feed possible flag is set, the feed fan duct 613 becomes open at the step S706 of FIG. 6), and at a step S909, the next detection timing by the sheet float-up lower limit sensor 607 and the sheet float-up upper limit sensor 608 is waited for.

On the other hand, if at the step S904, the sensor 608 has detected the sheet surface, at a step 906, the tray lifting and lowering motor 604 is driven to lower the cassette floor plate 602 by a predetermined distance, and at a step S908, the sheet feed possible flag is cleared to thereby stop the sheet feeding operation.

After the processing of the step S908 when the sheet float-up lower limit sensor 607 has not detected the sheet surface, or when the sheet float-up upper limit sensor 608 has detected the sheet surface, the step S909 of waiting until the next detection timing is executed. Here, the waiting time at the step S909 is judged by the sheet feed possible flag, and is controlled so as to be a relatively short time to detect any change in the sheet surface position with high resolving power during the sheet feeding operation in which the same flag is set, and to be a time which can satisfy both of the time until the sheet surface is moved by a predetermined distance and the time until the floated-up position of the sheet becomes stable by the sheet surface having been changed, during the stoppage of the sheet feeding operation in which the same flag is cleared.

Then, at a step S910, the completion of the feeding operation is determined, and if the feeding operation should be continued, return is made to the step S903, where the sheet surface position control is repeated, and if the feeding operation has been completed, return is made to the step S900, where the start of the next feeding operation is waited for.

Only the sheet float-up lower limit sensor may be provided to thereby control the tray lifting and lowering motor 604 so as to lift the cassette floor plate 602 by a predetermined amount on the basis of a change from a state in which the sheet float-up lower limit sensor detects the sheet to a state in which the same sensor does not detects the sheet. However, the float-up amount of the sheet floated up by the loosening fan 609 is various depending on the material of the sheet, the humidity absorbing state of the sheet resulting form room temperature and humidity, etc. Accordingly, it is difficult to appropriately estimate the float-up amount of the sheet. Consequently, in such a construction, it is feared that for example, double feed may occur due to the float-up amount being too great when the cassette floor plate 602 is lifted by a predetermined amount.

In a case where as in the above-described present embodiment, on the basis of the result of the detection by the two sensors, i.e., the sheet float-up lower limit sensor 607 and the sheet float-up upper limit sensor 608, control is effected so as to lower the cassette floor plate 602 if the position of the sheet is higher than an upper limit position, and to lift the cassette floor plate 602 if the position of the sheet is lower than a lower limit position, whereby in a case where the sheet is located within a range in which feeding is effected appropriately, as compared with a case where a single sensor is used, it becomes possible to effect the feeding of the sheets more stably.

Figure 13:
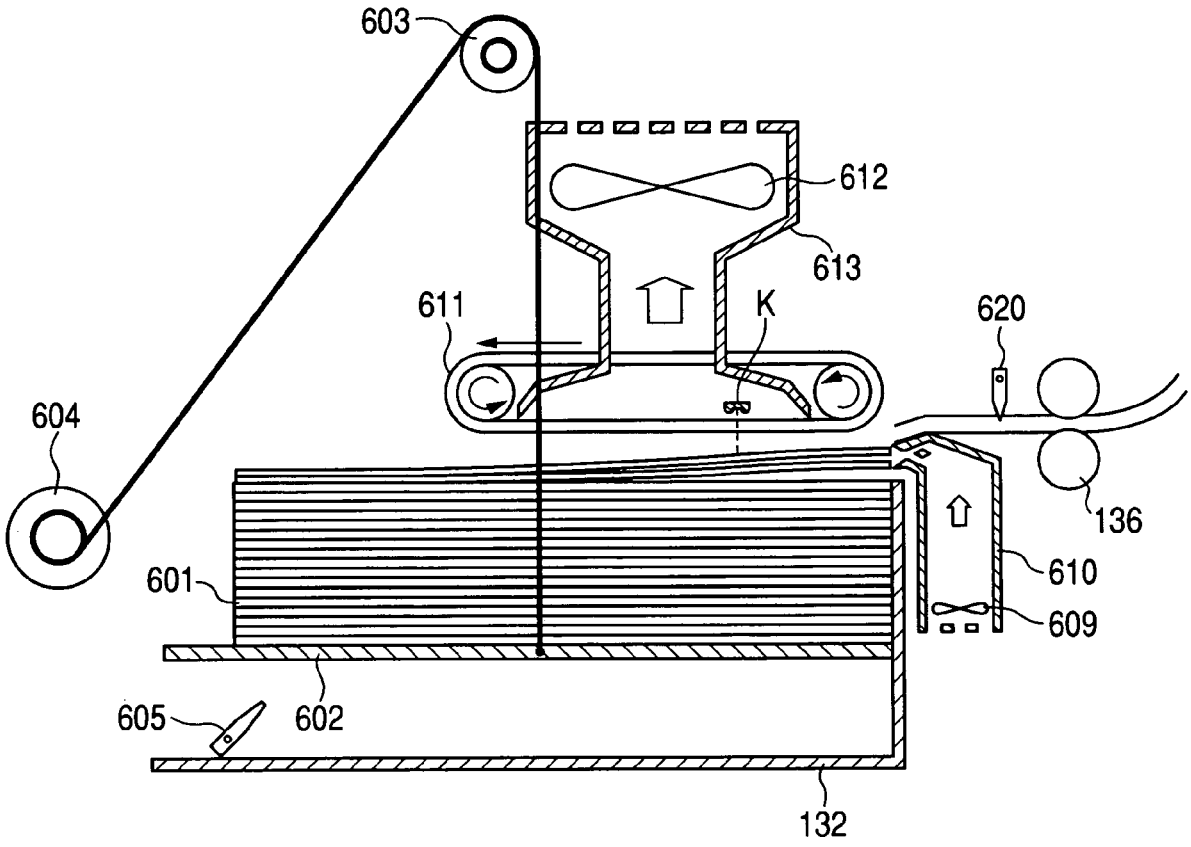
FIG. 13 is a cross-sectional view showing a modification of the present invention.

While in the present embodiment, description has been made of the control of locating the sheet surface of the uppermost sheet floated up by the loosening fan 609 within a predetermined range by using the sheet float-up lower limit sensor 607 and the sheet float-up upper limit sensor 608 as position detecting sensors, a distance measuring sensor K disposed on the feed belt 611 for measuring the distance from the feed belt 611 to the sheet surface of the sheet located below the feed belt 611 may be used as a position detecting sensor (see FIG. 13). By measuring the distance from the feed belt 611 to the sheet surface of the floated-up uppermost sheet by the distance measuring sensor K, it is possible to control the distance from the feed belt 611 so as to be located within a predetermined range, and even by such a construction, it is possible to obtain an effect similar to that of the above-described embodiment.

Thus, in the present embodiment, the sheet feeding operation can be performed with the sheet floated up to an appropriate position at which it can be sucked onto the feed belt 611, and therefore very stable sheet feeding such as reliable single sheet feeding can be realized at a low cost without being affected to the material or the like of the sheet.

<Processing by the Image Processing Portion 170, the Image Memory Portion 3 and the External I/F Processing Portion 4>

The processing by the image processing portion 170, the image memory portion 3 and the external I/F processing portion 4 will hereinafter be described with reference to FIGS. 9, 10 and 11.

Figure 9:
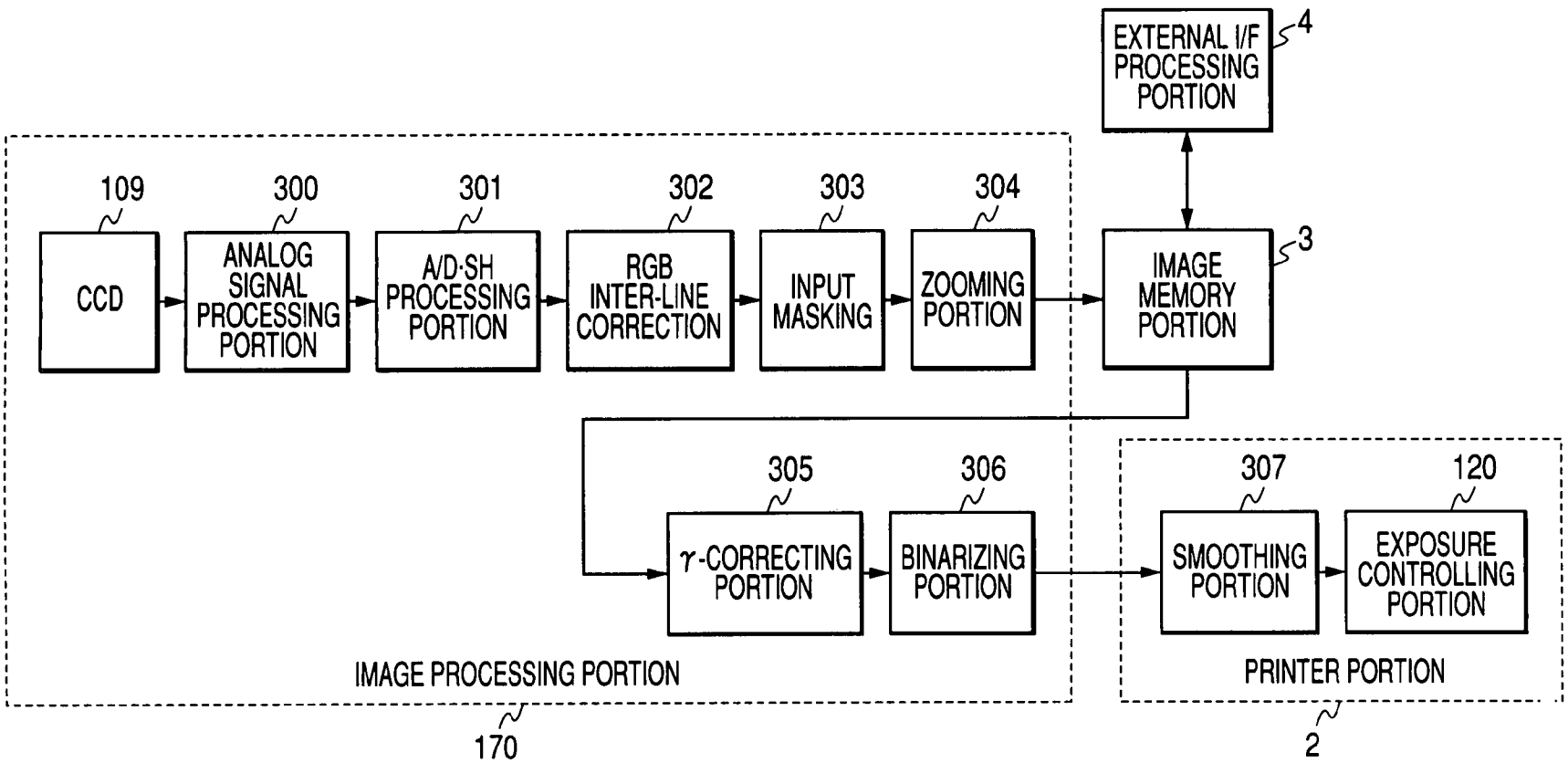
FIG. 9 is a block diagram showing the internal construction of an image processing portion according to the embodiment.

FIG. 9 is a block diagram showing the internal construction of the image processing portion 170.

First, describing the flow of processing when a scanned image is printed, an original image imaged on the CCD sensor 109 through the lens 108 is converted into an analog electrical signal by the CCD sensor 109. The converted image information is inputted to an analog signal processing portion 300, and is subjected to sampling and holding, the correction of a dark level, etc., and thereafter is analog/digital-converted (A/D-converted) by an A/D-SH processing portion 301, and further, shading correction is effected on the digitized signal. In the shading correction, correction for the unevenness of each pixel the CCD sensor 109 has, and correction for the unevenness of the quantity of light based on the light distributing characteristic of the original illuminating lamp 103 are effected.

Thereafter, in an RGB inter-line correcting portion 302, correction among R (red), G (green) and B (blue) lines is effected. Light inputted to each of the R, G and B light receiving portions of the CCD sensor 109 at a certain point of time deviates on the original in accordance with the positional relation of the respective R, G and B light receiving portions and therefore, synchronism is taken here among the R, G and B signals.

Subsequently, an input masking process is carried out in an input masking portion 303, and conversion from luminance data into density data is effected. That is, the RGB value as it has been outputted from the CCD sensor 109 is affected by a color filter mounted on the CCD sensor 109 and therefore, the influence thereof is corrected and the aforementioned RGB value is converted into a genuine RGB value. Thereafter, the image data is zooming-processed at a desired zooming rate in a zooming portion 304, and the zooming-processed image data is sent to and accumulated in the image memory portion 3. Image data from a computer 11 shown in FIG. 11 is also inputted to the image memory portion 3 through an external I/F processing portion 4.

When the accumulated images are to be printed, the image data is first sent from the image memory portion 3 to a γ-correcting portion 305. In the γ-correcting portion 305, in order to provide output data corresponding to a density value set by the operating portion 203, original density data is converted into density data corresponding to desired output density on the basis of a look-up table (LUT) taking the characteristic of the printer into account.

Thereafter, the density data is sent to a binarizing portion 306. In the binarizing portion 306, the binarization of multi-value density data is effected. In the case of multi-value density data, e.g. density data of 8 bits, the density value assumes a value between "0" to "255", but by being binarized, the density value becomes, for example, "0" or "255". That is, in order to represent the density of a certain pixel, data of 8 bits was necessary, whereas by being binarized, a data amount of 1 bit becomes enough. Thereby, a memory capacity for storing the image data is reduced. On the other hand, however, the gradation of the image changes from the original 256 gradations to 2 gradations and therefore, in the case of image data including many halftones such as a photographic image, it is said that the quality of image thereof is generally remarkably deteriorated by the binarization of the image.

So, pseudo halftone expression by binarized data becomes important. Here, an error diffusing method is used as a technique of effecting halftone expression in a pseudo fashion by binary data. In this method, when the density of a certain image is greater than a certain threshold value, it is regarded as density data of "255", and when it is equal to or less than a certain threshold value, it is regarded as density data of "0" and is binarized, thereafter the difference between actual density data and the binarized density data is obtained as an error signal, and is distributed to peripheral pixels. The distribution of the error is effected by multiplying the error resulting from the binarization by a weight coefficient on a predetermined matrix, and adding the result to the peripheral pixels. Thereby, the average density value of the entire image is preserved, and the halftone can be expressed in a pseudo fashion by binary.

The binarized density data is sent to a smoothing portion 307 in the printer portion 2. In the smoothing portion 307, the complementing of the data is effected so that the end portions of the line of the binarized image may become smooth, and the image data subjected to the complementing is outputted to the exposure controlling portion 120. The exposure controlling portion 120, as previously described, forms the electrostatic image of the image data on the photosensitive drum 110.

Description will now be described of the flow of the processing when the scanned image data is forwarded via a network.

The first half portion of the description in which the density data is accumulated in the image memory portion 3 is the same as the flow of the processing during the aforedescribed print, thereafter the image data is sent form the image memory portion 3 to the external I/F processing portion 4, from which the image data is forwarded to a desired computer via the network.

Figure 10:
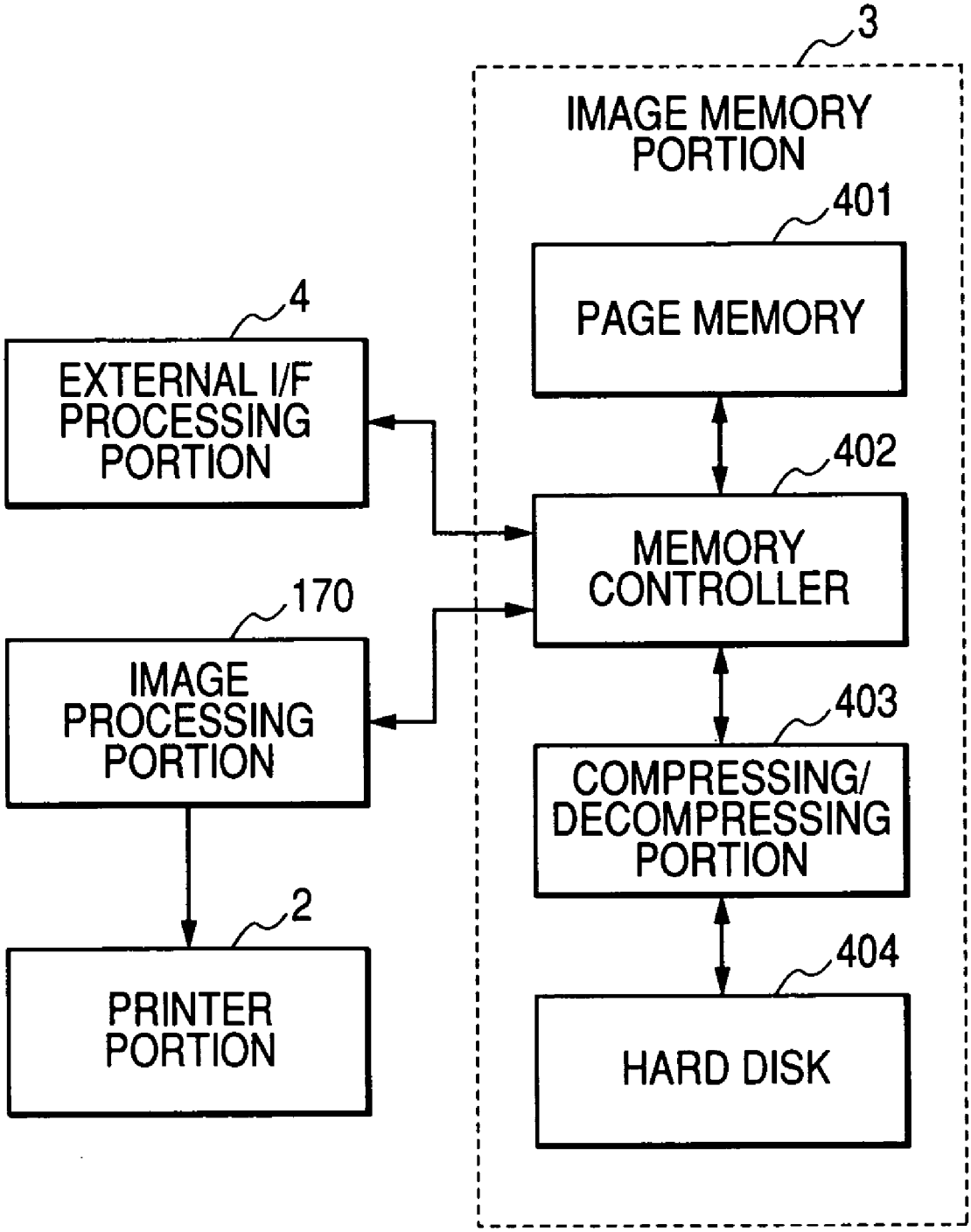
FIG. 10 is a block diagram showing the internal construction and the peripheral portion of an image memory portion according to the embodiment.

FIG. 10 is a block diagram showing the interval construction and peripheral portion of the image memory portion 3.

The image memory portion 3 is comprised of a page memory 401, a memory controller portion 402, a compressing/decompressing portion 403 and a hard disk 404.

The image data sent from the external I/F processing portion 4 and the image processing portion 170 to the image memory portion 3 is written into the page memory 401 by the memory controller portion 402, and thereafter is sent to the printer portion 2 through the image processing portion 170, or is accumulated in the hard disk 404. When the image data is to be accumulated in the hard disk 404, the image data is data-compressed in the compressing/decompressing portion 403, and is written into the hard disk 404 as compressed data.

Also, the memory controller portion 402 effects the reading-out of the image data stored in the hard disk 404 to the page memory 401. At that time, the compressed data read out from the hard disk 404 is decompressed through the compressing/decompressing portion 403, and the image data restored to the original state is written into the page memory 401. Further, the memory controller portion 402 effects the generation of a DRAM refreshing signal to be sent to the page memory 401. It also effects the mediation of the access from the external I/F processing portion 4, the image processing portion 170 and the hard disk 404 to the page memory 401. It further effects the determination control of a writing address to the page memory 401, a reading-out address from the page memory 401, and a reading-out direction or the like in accordance with the instructions of the CPU 201. By these processes, the CPU 201 arranges a plurality of original images and effects lay out in the page memory 401 and moreover, becomes capable of controlling the function of outputting them to the printer portion 2 through the image processing portion 140, the function of cutting out and outputting only a part of the images, and the function of effecting the rotation of the images.

Also, for example, regarding a sorting mode, the control of reading out and printing images in the order in which they have been recorded in the image memory portion 3 is repeated a plurality of times and executed on a certain original bundle. By such control being effected, even in a finisher having only a few bins like the discharged sheet processing apparatus 190 in the present embodiment, the same role as that of a sorter having a number of bins can be played.

Figure 11:
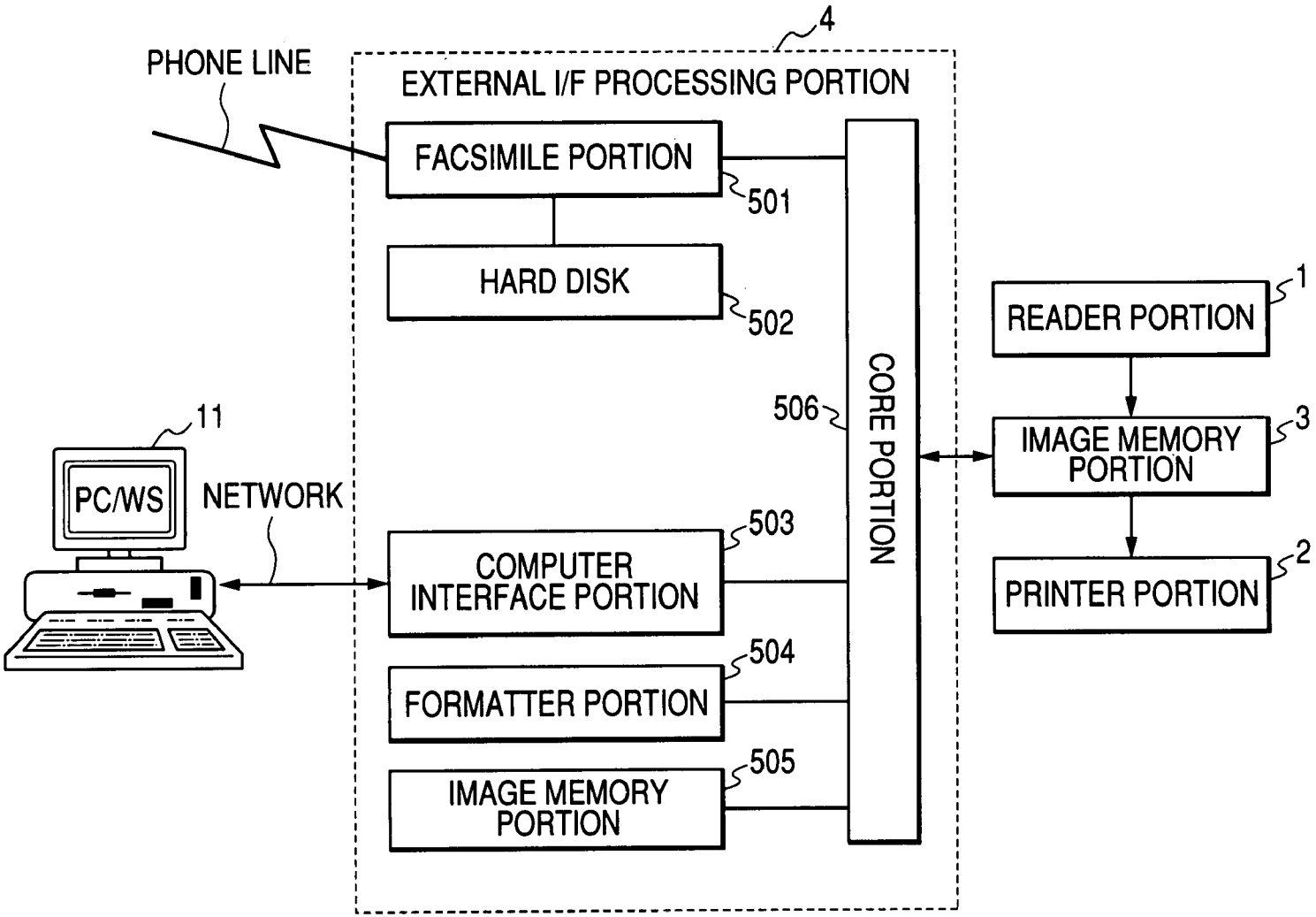
FIG. 11 is a block diagram showing the internal structure and the peripheral portion of an external I/F processing portion.

FIG. 11 is a block diagram showing the internal structure and peripheral portion of the external I/F processing portion 4.

The external I/F processing portion 4 introduces image data from the reader portion 1 thereinto through the image memory portion 3, and sends the image data to an external computer or an external facsimile apparatus through a network or a phone line. Also, it outputs image data send thereto from the external computer or the external facsimile apparatus through the phone line to the printer portion 2 through the image memory portion 3 and the image processing portion 170 to thereby effect image forming.

The external I/F processing portion 4 is comprised of a core portion 506, a facsimile portion 501, a hard disk 502 for preserving the communication image data of the facsimile portion 501 therein, a computer interface portion 503 connected to an external computer 11, a formatter portion 504 and an image memory portion 505.

The facsimile portion 501 is connected to a public phone line through a modem (not shown), and effects the reception of facsimile communication data from the public phone line and the transmission of facsimile communication data to the public phone line. In the facsimile portion 501, the facsimile function of effecting facsimile transmission at a designated time, or transmitting image data in response to an inquiry by a designated password from a partner is realized by the utilization of an image for facsimile preserved in the hard disk 502. Thereby, after an image has once been sent from the reader portion 1 to the facsimile portion 501 through the image memory portion 3 and the image has been preserved in the hard disk 502 for facsimile, facsimile transmission can be effected without the reader portion 1 and the image memory portion 3 being used for the facsimile function.

The computer interface portion 503 is an interface portion which effects data communication with the external computer 11, and has a local area network (LAN), a serial I/F, an SCSI-I/F, a centro I/F for inputting the data of the printer, etc. Through this computer interface portion 503, the states of the printer portion 2 and the reader portion 1 are communicated to the external computer 11. Or by the instructions from the external computer 11, the forwarding of an image read by the reader portion 1 to the external computer 11 is effected.

The computer interface portion 503 also receives print image data from the external computer 11. At that time, the print image data communicated from the external computer 11 is described in an exclusive printer code and therefore, in the formatter portion 504, the communicated data code is converted into raster image data which can effect image forming in the printer portion 2. The converted raster image data is evolved to the image memory portion 505 by the formatter portion 504.

On the other hand, when the image data is to be transmitted to the external computer 11 through the computer interface portion 503, the image formatter 504 effects the conversion of the print image data sent thereto from the image memory portion 3 into an image format recognizable by the external computer 11, in the image memory portion 505.

The image memory portion 505 is used as a memory which evolves the raster image data of the formatter portion 504, as described above, and besides, is also used when the image data from the reader portion 1 is sent to the external computer 11 (network scanner function). That is, when the image from the reader portion 1 is to be sent to the external computer 11 via the computer interface portion 503, the image data sent from the image memory portion 3 is once evolved to the image memory portion 505, where it is converted into the form of data to be sent to the external computer 11, and then is transmitted from the computer interface portion 503 to the external computer 11.

The core portion 506 controls and manages data forwarding mutually effected among the facsimile portion 501, the computer interface portion 503, the formatter portion 504, the image memory portion 505 and the image memory portion 3. Thereby, even if a plurality of image output portions are connected to the external I/F processing portion 4, and even if the image forwarding path to the image memory portion 3 is single, exclusive control and degree-of-priority control are effected under the management by the core portion 506 and therefore, image outputting is effected appropriately.

The present invention is not restricted to the apparatus of the above-described embodiment, but may be applied to a system comprised of a plurality of apparatuses, or may be applied to an apparatus comprising a single device. Of course, the present invention is also completed by supplying a system or an apparatus with a storage medium storing therein the program code of software for realizing the function of the aforedescribed embodiment, and the computer (or CPU or MPU) of the system or the apparatus reading out and executing the program code stored in the storage medium.

In this code, the program code itself read out form the storage medium realizes the function of the aforedescribed embodiment and thus, the storage medium storing the program code therein constitutes the present invention. As the storage medium for supplying the program code, use can be made, for example, of a Floppy (registered trademark) disk, a hard disk, an optical disk, a magneto-optical disk, a CD-ROM, a CD-R, a magnetic tape, a non-volatile memory card or a ROM. Also, of course, by the program code read out by the computer being executed, not only the function of the aforedescribed embodiment is realized, but also there is covered a case where on the basis of the instructions of the program code, an OS or the like working on the computer effects part or the whole of actual processing, and by the processing, the function of the aforedescribed embodiment is realized.

Further, of course, there is also covered a case where the program code read out from the storage medium is written into a memory provided in a function enlarging board inserted in a computer or a function enlarging unit connected to a computer, thereafter on the basis of the instructions of the next program code, a CPU or the like provided in the enlarging board or the enlarging unit performs the enlarging function to thereby effect part or the whole of actual processing, and by the processing, the function of the aforedescribed embodiment is realized.

This application claims priority from Japanese Patent Application No. 2004-083349 filed on Mar. 22, 2004, which is hereby incorporated by reference herein.

What is claimed is:

1. A sheet feeding apparatus for feeding sheets, comprising:

a sheet tray having a stacking surface on which sheets are stacked;

a fan which blows air against the sheets so as to float up a sheet stacked on said sheet tray;

a sheet feeder which feeds the sheet floated up by said fan;

a position detecting unit configured to detect a position of the sheet which is being floated up by said fan; and a tray lifting and lowering mechanism which lifts and lowers said sheet tray on the basis of a result of detection by said position detecting unit, wherein when it is detected by said position detecting unit that the floated-up sheet is outside a predetermined range, said tray lifting and lowering mechanism lifts or lowers said sheet tray so that the floated-up position of the sheet is within said predetermined range, and when it is detected by said position detecting unit that the floated-up sheet is within said predetermined range, said tray lifting and lowering mechanism neither lifts nor lowers said sheet tray, and wherein when it is detected by said position detecting unit that the floated-up sheet is outside said predetermined range, said position detecting unit detects again a position of the floated-up sheet after a first time period has passed, and when it is detected by said position detecting unit that the floated-up sheet is within said predetermined range, said position detecting unit detects again a position of the floated-up sheet after a second time period shorter than said first time period has passed.

2. A sheet feeding apparatus according to claim 1, wherein said position detecting unit has an upper limit position detecting unit for detecting the sheet at an upper limit position of said predetermined range, and a lower limit position detecting unit for detecting the sheet at a lower limit position of said predetermined range.

3. A sheet feeding apparatus according to claim 1, wherein said position detecting unit is a distance measuring unit for measuring a distance from said sheet feeder to the uppermost sheet floated up by said fan.

4. A sheet feeding apparatus according to claim 1, wherein said sheet feeder has a belt which sucks and feeds the sheet floated up by said fan.

5. An image forming apparatus comprising:

a sheet tray having a stacking surface on which sheets are stacked;

a fan which blows air against the sheets to float up a sheet stacked on said sheet tray;

a sheet feeder which feeds the sheet floated up by said fan;

an image forming unit which forms images on the sheet fed by said sheet feeder;

a position detecting unit configured to detect a position of the sheet which is being floated up by said fan; and a tray lifting and lowering mechanism which lifts and lowers said sheet tray on the basis of a result of detection by said position detecting unit, wherein when it is detected by said position detecting unit that the floated-up sheet is outside a predetermined range, said tray lifting and lowering mechanism lifts or lowers said sheet tray so that the floated-up position of the sheet is within said predetermined range, and when it is detected by said position detecting unit that the floated-up sheet is within said predetermined range, said tray lifting and lowering mechanism neither lifts nor lowers said sheet tray, and wherein when it is detected by said position detecting unit that the floated-up sheet is outside said predetermined range, said position detecting unit detects again a position of the floated-up sheet after a first time period has passed, and when it is detected by said position detecting unit that the floated-up sheet is within said predetermined range, said position detecting unit detects again a position of the floated-up sheet after a second time period shorter than said first time period has passed.

6. An image forming apparatus according to claim 5, wherein said position detecting unit has an upper limit position detecting unit for detecting the sheet at an upper limit position of said predetermined range, and a lower limit position detecting unit for detecting the sheet at a lower limit position of said predetermined range.

* * * * *